US007082782B2

(12) United States Patent
Schlosser et al.

(10) Patent No.: US 7,082,782 B2
(45) Date of Patent: Aug. 1, 2006

(54) LOW-VOLUME ICE MAKING MACHINE

(75) Inventors: Charles E. Schlosser, Manitowoc, WI (US); Richard T. Miller, Manitowoc, WI (US); Scott J. Shedivy, Reedsville, WI (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 0 days.

(21) Appl. No.: 10/898,449

(22) Filed: Jul. 23, 2004

(65) Prior Publication Data

US 2005/0044875 A1 Mar. 3, 2005

Related U.S. Application Data

(60) Provisional application No. 60/498,765, filed on Aug. 29, 2003.

(51) Int. Cl.
*F25C 1/06* (2006.01)

(52) U.S. Cl. ..... 62/347

(58) Field of Classification Search ..... 62/74, 62/347

See application file for complete search history.

(56) References Cited

U.S. PATENT DOCUMENTS

| | | | | |
|---|---|---|---|---|
| 3,080,726 | A | 3/1963 | Tenniswood | |
| 3,470,709 | A | 10/1969 | Asakawa | |
| 3,866,434 | A | 2/1975 | Pugh et al. | |
| 4,378,680 | A | 4/1983 | Garland | |
| 4,412,429 | A * | 11/1983 | Kohl | 62/347 |
| 4,489,566 | A | 12/1984 | Saltzman | |
| 4,530,218 | A | 7/1985 | Janke et al. | |
| 4,665,708 | A | 5/1987 | Tate, Jr. et al. | |
| 5,054,547 | A | 10/1991 | Shipley | |
| 5,160,094 | A | 11/1992 | Willis et al. | |
| 5,245,841 | A | 9/1993 | Paul et al. | |
| 5,261,248 | A | 11/1993 | Willis et al. | |
| 5,297,394 | A | 3/1994 | Frohbieter et al. | |
| 5,477,694 | A | 12/1995 | Black et al. | |
| D369,608 | S | 5/1996 | Ratchford | |
| 5,715,689 | A | 2/1998 | Byczynski et al. | |
| 5,996,361 | A | 12/1999 | Bessler et al. | |
| 6,058,731 | A | 5/2000 | Byczynski et al. | |
| 6,148,621 | A | 11/2000 | Byczynski et al. | |
| 6,161,396 | A | 12/2000 | Allison et al. | |
| 6,286,324 | B1 | 9/2001 | Pastryk et al. | |

(Continued)

FOREIGN PATENT DOCUMENTS

DE 936 042 12/1955

*Primary Examiner*—William E. Tapolcai
(74) *Attorney, Agent, or Firm*—Brinks Hofer Gilson & Lione

(57) ABSTRACT

An ice machine includes an evaporator with a plurality of individual ice-forming cells. Each ice-forming cell is open at a lower end. A water distributor is coupled to the evaporator and configured to deliver water to the upper end of each ice-forming cell. A refrigeration system in the ice machine is configured to cool each of the plurality of ice-forming cells, such that individual ice cubes are formed in each ice-forming cell. A water recirculation system includes a water collection unit positioned between the evaporator and a water sump. The water collection unit collects water flowing from the ice-forming cells in first and second chambers. A water detection probe is positioned in the second chamber. A harvest cycle is initiated when the water level in the second chamber falls below a specified level. A method of operating the ice machine is also provided.

34 Claims, 6 Drawing Sheets

U.S. PATENT DOCUMENTS 6,311,501 B1 * 11/2001 Allison et al. ..... 62/74
6,334,319 B1 1/2002 Senner
6,438,976 B1 8/2002 Shapiro et al.
6,539,742 B1 4/2003 Mitchell et al.
6,574,974 B1 6/2003 Herzog et al.

* cited by examiner

LOW-VOLUME ICE MAKING MACHINE

RELATED APPLICATIONS

The present patent document claims priority to Provisional Application Ser. No. 60/498,765, filed Aug. 29, 2003, which is hereby incorporated by reference.

FIELD OF THE INVENTION

The present invention relates, in general, to ice making machines and, more particularly, to low-volume ice making machines suitable for residential or commercial use.

BACKGROUND

Ice making machines are in widespread use for supplying cube ice in commercial operations. Typically, the ice making machines produce a large quantity of ice by flowing water over a large chilled surface. The chilled surface is thermally coupled to evaporator coils that are, in turn, coupled to a refrigeration system. The chilled plate, or evaporator, contains a large number of indentations on its surface where water flowing over the surface can collect. Typically, the indentations are die-formed recesses within a metal plate having high thermal conductivity. As water flows over the indentations, it freezes into ice.

To harvest the ice, the evaporator is heated by hot vapor flowing through the evaporator coils. The evaporator plate is warmed to a temperature sufficient to harvest the ice from the evaporator. Once freed from the evaporator surface, a large quantity of ice cubes are produced, which fall into an ice storage bin. The ice cubes produced by a typical ice making machine are square or rectangular in shape and have a somewhat thin profile. Rather than having a three-dimensional cube shape, the ice cubes are tile-shaped and have small height and width dimensions.

In contrast to ice cubes produced by an ice machine, ice cubes produced in residential refrigerators are typically cube-shaped and larger than the ice cubes produced by a commercial ice making machine. Larger ice cubes are desirable for chilling beverages in beverage glasses commonly used in the home. Cubes that can be conveniently picked up by tongs are particularly desirable. Also, ice made by conventional ice making machines freezes running water to produce clear ice cubes, which are desirable. Most domestic ice makers found in refrigerators freeze standing water, which produces clouded ice that is less desirable.

In addition to producing small ice cubes, conventional ice making machines are typically large and bulky machines that require a large amount of space. An ice machine for domestic use, on the other hand, needs to have a small footprint and a compact size that can fit under countertops of cabinetry typically found in domestic kitchens. Ice making machines for domestic use must operate using electricity available at residential current and voltage.

Several ice machines have been developed and sold for the residential market. Typically, such ice machines do not produce large cubes of clear ice. One model produces large, clear cubes, but uses an evaporator that is fairly difficult to produce. Also, the evaporator is not totally reliable and uses spray jets that have a tendency to get plugged up, especially when routine maintenance is not carried out. Nonexistent or, at best, infrequent maintenance is typical for residential ice machines. Accordingly, a need exists for a compact ice making machine capable of producing large cubes of clear ice, with the machine being reliable and compatible for both residential and commercial use, and which can be built at a reasonable cost using automated technology.

BRIEF SUMMARY

In one embodiment, the invention includes an ice machine having an evaporator with a plurality of individual ice-forming cells. Each ice-forming cell has a closed perimeter and an opening at a lower end. A water distributor is coupled to the evaporator and configured to deliver water at or near an upper end of each of the plurality of individual ice-forming cells, so that the water flows downward inside the perimeter of the individual ice-forming cells. A water recirculation system including a sump, a water pump positioned within the sump, and a water recirculation line is coupled to the water pump and to the water distributor. A refrigeration system is configured to cool each of the plurality of ice-forming cells from outside the perimeter, such that individual ice cubes are formed in the ice-forming cells.

In another embodiment of the invention, an ice machine monitoring system includes an electronic control unit and an evaporator configured to produce ice cubes and to discharge excess water. A water retention unit has a first chamber and a second chamber, where the first chamber is configured to receive the excess water from the evaporator and to deliver water to the second chamber. A water detection probe is positioned in the second chamber and configured to detect the presence of water flowing into the second chamber from the first chamber and to transmit a signal to the electronic control unit.

In yet another embodiment of the invention, an ice machine includes an evaporator having a plurality of individual ice-forming cells, where each cell has a closed perimeter and an opening at a lower end. A water disperser is positioned in an upper end of each of the plurality of individual ice-forming cells. The water disperser includes a splash plate positioned within the water disperser and attached to an inner wall thereof. The splash plate directs a flow of water entering the upper end of the ice-forming cell outward onto an inner surface of the ice-forming cell.

In still another embodiment of the invention, a clear ice cube produced by an ice making machine includes upper and lower ends and an opening in a center portion extending from the upper end to the lower end. The opening has a relatively larger cross section at the upper and lower ends and a relatively smaller cross section in a midsection of the ice cube.

In a further embodiment of the invention, an ice machine includes a multi-level evaporator having at least two levels. Each level includes a plurality of individual ice-forming cells, each ice-forming cell having a closed perimeter and an opening at a lower end. The ice-forming cells are vertically aligned to form vertical cell stacks. A thermal insulator is positioned between the ice-forming cells in the vertical cell stacks. A water distributor is coupled to the evaporator and configured to deliver water at or near an upper end of each of the plurality of individual ice-forming cells in an uppermost level. A water recirculation system includes a sump, a water pump positioned within the sump, and a water recirculation line coupled to the water pump and to the water distributor. The water distributor is configured to deliver water to the multi-level evaporator such that the water flows downward from the uppermost level in each cell stack and out of the multi-level evaporator through a lowermost level and into the sump.

In a still further embodiment of the invention, a method of operating an ice machine includes circulating water through a plurality of hollow ice-forming cells while cooling the ice-forming cells with a refrigerant, and monitoring the flow of water through the ice-forming cells, and initiating a harvest cycle to expel ice cubes from the ice-forming cells when a decrease in the flow rate of water through the ice-forming cells is detected.

In an additional embodiment of the invention, a method of operating an ice machine includes forming ice cubes in individual ice-forming cells, and initiating a harvest cycle to release the ice cubes from the individual ice-forming cells, and detecting the fall of ice cubes from the ice-forming cells, and monitoring a time interval between each ice cube detection event, and if no detection events occur over a predetermined time interval, control returns to forming ice cubes and subsequently initiating a harvest cycle.

In another additional embodiment of the invention, an ice machine includes an evaporator means having a plurality of individual ice-forming cells, each cell having a closed perimeter and an opening at a lower end. Water distributor means is coupled to the evaporator means for delivering water at or near an upper end of each of the plurality of individual ice-forming cells. The ice machine also includes water recirculation means for recirculating water that passes through the ice-forming cells back to the water distributor means, and refrigeration means for cooling each of the plurality of ice-forming cells from outside the perimeter, such that individual ice cubes are formed in the ice-forming cells.

In a further additional embodiment of the invention, a method of operating an ice machine includes using a water pump to pump water from a water sump through a water distributor and to an evaporator coupled to the water distributor, the evaporator having a plurality of individual ice-forming cells, each cell an opening at a lower end; and cooling each of the plurality of ice-forming cells, such that individual ice cubes are formed in the ice-forming cells; stopping the water pump and harvesting ice cubes from the ice-forming cells, while monitoring the fall of ice cubes from the ice-forming cells and recording a sequential number of harvest cycles. On every pre-programmed number of harvest cycles, the water pump is started to pump water to the water distributor and to the evaporator, and a water inlet valve is opened to flow water into the water sump. The method further comprises continuing to operate the water pump and to flow water into the water sump until a water level in the water sump contacts a sensor positioned in the water sump; stopping the water pump such that water flows into the water sump from the water distributor and the evaporator and raises the water level sufficiently to activate a siphon drain in the water sump; draining water from the water sump until the siphon drain stops; continuing to flow water into the water sump through the water inlet until the water level rises and contacts the sensor; restarting the water pump to pump water to the water distributor and to the evaporator; continuing to operate the water pump and to flow water into the water sump until a water level in the water sump again contacts a sensor positioned in the water sump; and closing the water inlet valve.

It will be appreciated that for clarity of illustration, not all elements shown in the figures have been drawn to scale, for example, some elements are exaggerated relative to other elements.

DETAILED DESCRIPTION

Figure 1A:
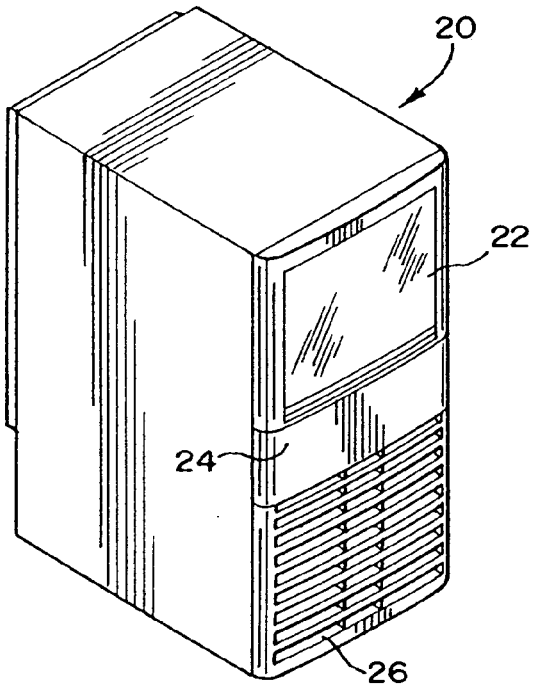
FIG. 1A is a perspective view of a cabinet for housing an ice-forming machine in accordance with the invention
Figure 1B:
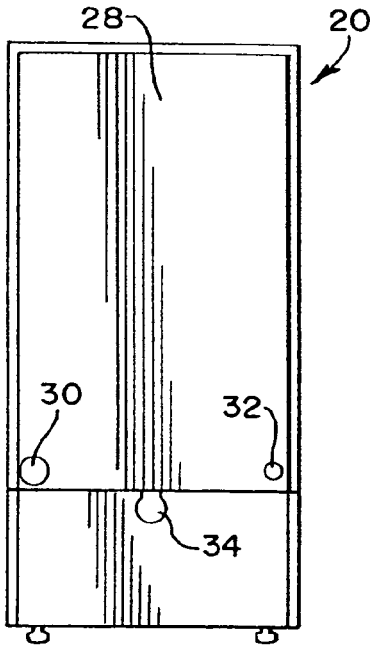
FIG. 1B is an elevational view showing the rear panel of the cabinet illustrated in FIG. 1A.

In accordance with a preferred embodiment the invention, an ice machine is provided that produces large, individual, clear ice cubes, and is contained within a compact-sized cabinet suitable for use in either residential or commercial settings. One embodiment of a cabinet suitable for housing the ice machine of the invention is illustrated in FIGS. 1A and 1B. Cabinet 20 is configured to stand upright on a horizontal surface and has a somewhat narrow profile to facilitate positioning cabinet 20 in small spaces found within a residential kitchen or small commercial kitchen. In one embodiment of the invention, cabinet 20 has a height of no more than about thirty inches, a depth of no more than about twenty three inches and a width of no more than about fifteen inches.

Ice cubes can be accessed from an ice storage bin (not shown) through a door 22 on a front face 24. Front face 24 also includes a cooling vent 26 that permits the flow of air to the refrigeration system of the ice machine. Cabinet 20 is preferably constructed of a combination of durable materials including plastics and lightweight metal alloys. Electrical and water service to the ice machine is provided through the rear panel shown in FIG. 1B. Rear panel 28 has a water inlet connection 30, electrical port 32 and a water drain connection 34. Although the service connections are illustrated at a particular location on rear panel 28, the service connections can be positioned in a variety of locations on the rear panel, or alternatively, on a side panel of cabinet 20.

Figure 2:
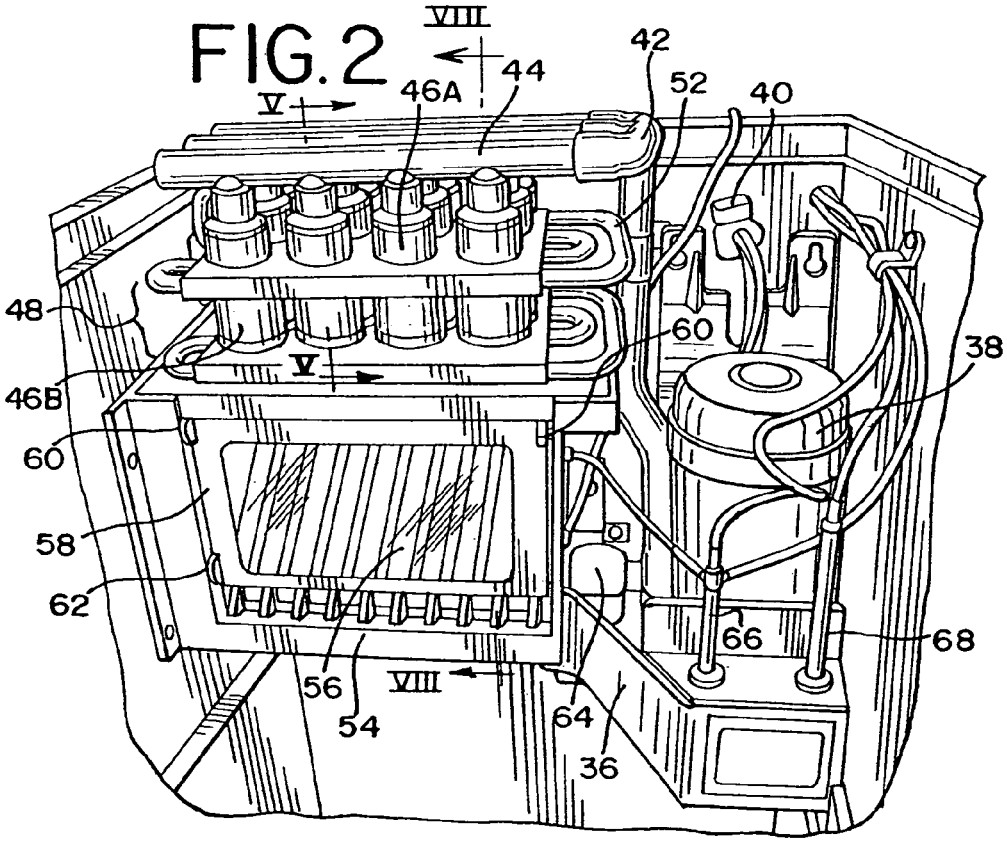
FIG. 2 is a partial front view of an ice making machine configured in accordance with the invention.

A perspective view of several functional components of the ice machine is illustrated in FIG. 2. The components shown in FIG. 2 include water recirculation means, which in one embodiment includes, a water sump 36, a water pump 38, and a water recirculation line 40. Water recirculation line 40 is coupled to a water distributor 42. Water distributor means, which in one embodiment is constituted by water distributor 42, includes manifold lines 44 that feed water to individual ice-forming cells 46A and 46B of an evaporator 48. Evaporator 48 includes refrigerant lines 52 that transfer heat from individual ice-forming cells 46 to freeze water flowing into the cells from manifold lines 44.

Ice cubes produced in ice-forming cells 46A and 46B fall into a transfer compartment 54. Transfer compartment 54 includes an inclined slotted surface 56 that directs the ice cubes toward a damper 58. Damper 58 is mounted on hinges 60 and is equipped with a magnet 62 that works in conjunction with an ice damper switch (shown in silhouette as element 63 in FIG. 10). In one embodiment, ice damper switch 63 is a reed switch; alternatively, ice damper switch 63 can be a Hall effect sensor, or the like. Damper 58 is configured to swing open on hinges 60 each time an ice cube impacts the inner surface of damper 58.

Those skilled in the art will recognize that the arrangement of components illustrated in FIG. 2 is but one of many possible arrangements. Accordingly, the position of the components relative to one another can be different from that shown in FIG. 2. For example, the motor of pump 38 can be located below transfer compartment 54, or outside of the freezing and water compartment. Further, the size of transfer compartment 54 can vary depending upon the ice making capacity of the ice machine.

A sump drain system 64 resides in a bottom portion of water sump 36. As will subsequently be described, sump drain system 64 is configured to siphon water from water sump 36 during water draining and refilling operations. Water sump 36 is also equipped with a sump sensor 66 and a reference probe 68. As will subsequently be described, sump sensor 66 and reference probe 68 operate to provide signals for the electronic control system during operation of the ice machine. Preferably, sump sensor 66 and reference probe 68 are capacitance probes, although other kinds of water sensing probes can also be used.

Figure 3:
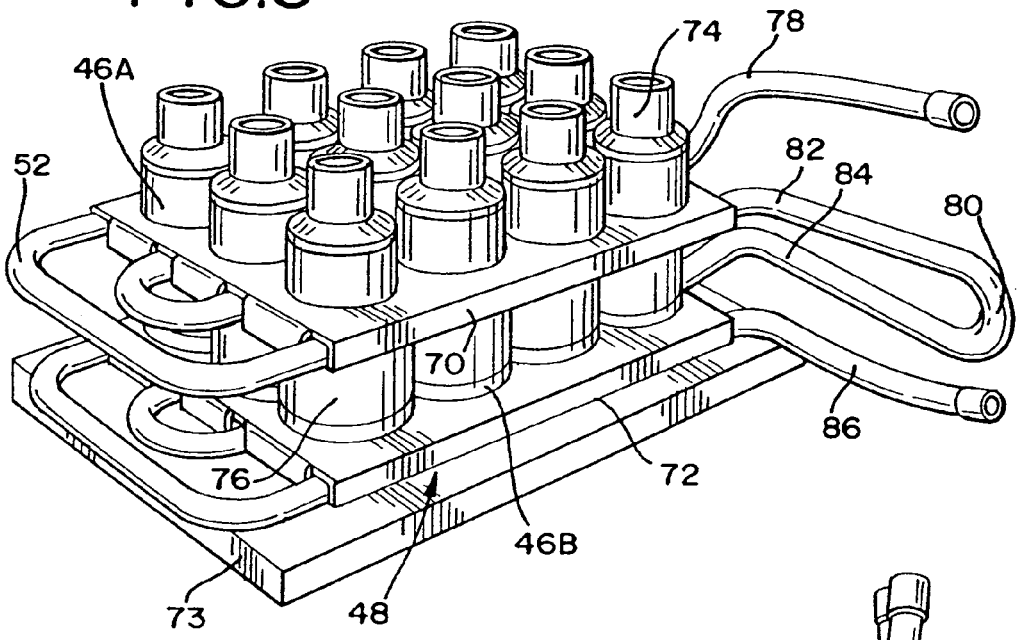
FIG. 3 is a perspective view of a double evaporator of the ice making machine illustrated in FIG. 2.

FIG. 3 is a perspective view of evaporator 48. In the embodiment illustrated in FIG. 3, evaporator means, which in one embodiment of the invention constitutes evaporator 48, is equipped with an upper thermally conductive plate 70 and a lower thermally conductive plate 72. Individual ice-forming cells 46A are positioned in upper thermally conductive plate 70 and ice-forming cells 46B are positioned in lower thermally conductive plate 72. Lower thermally conductive plate 72 rests on an upper member 73 of transfer compartment 54.

Each ice-forming cell 46A has a water disperser 74 positioned in an upper end of the cell. A thermally insulating coupler 76 connects ice-forming cells 46A with ice-forming cells 46B. An inlet 78 of refrigerant line 52 enters upper thermally conductive plate 70 and traverses across a lower surface of upper thermally conductive plate 70 between adjacent rows of ice-forming cells 46A. A connector 80 connects an outlet portion 82 of refrigerant line 52 to an inlet portion 84. Inlet portion 84 enters lower thermally conductive plate 72 and traverses along a lower surface of lower thermally conductive plate 72 between adjacent rows of ice-forming cells 46B. An outlet 86 returns refrigerant to be recycled through the refrigeration system of the ice machine.

Figure 4:
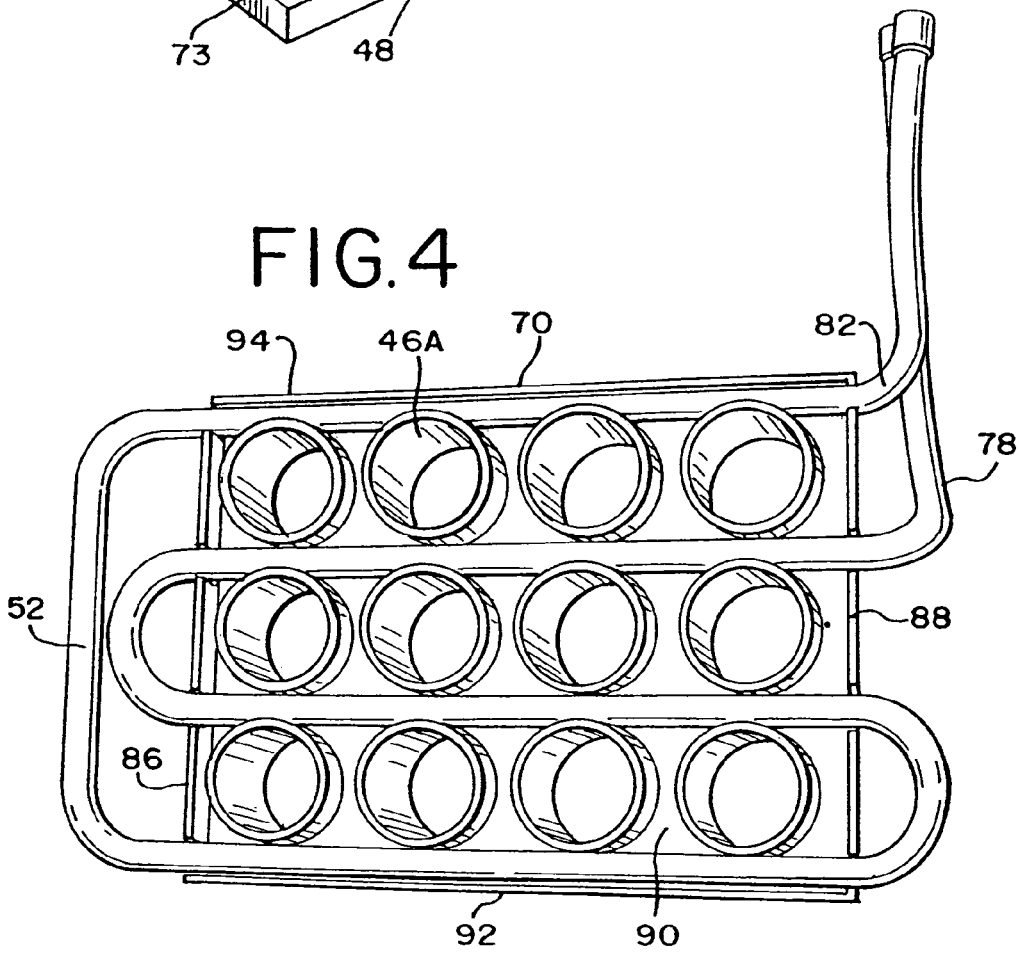
FIG. 4 is a bottom view of one of the evaporator plates in the ice making machine illustrated in FIG. 2.

The serpentine configuration of refrigerant line 52 is illustrated in the bottom view of upper thermally conductive plate 70 illustrated in FIG. 4. Refrigerant line 52 is secured to opposing elongated sides 92 and 94 and to lower surface 90 of upper thermally conductive plate 70. Refrigerant line 52 is connected in an identical way to lower thermally conductive plate 72. Refrigerant line 52 is arranged such that refrigerant flows through inlet portion 78 and traverses across a central portion of upper thermally conductive plate 70 first, and then along the perimeter of upper thermally conductive plate 70 before exits through outlet portion 82. In this way, upper thermally conductive plate 70 is subjected to the lowest temperature portion of refrigerant line 52 in the central part of the plate. The same refrigerant flow pattern is used for lower thermally conductive plate 72. Those skilled in the art will appreciate that other flow patterns are possible. For example, the refrigerant flow can be directed to the perimeter of the plate first, and then to the central portion of the plate, or divided and flow simultaneously in different parts of the plate.

As illustrated in FIG. 4, ice-forming cells 46A are arranged in regular rows and columns in upper thermally conductive plate 70. Each of ice-forming cells 46A is soldered into an opening in the thermally conductive plate. Ice-forming cells 46A extend through thermally conductive plate 70, such that a central axis passing through ice-forming cells 46A is oriented about 90° with respect to the plane of thermally conductive plate 70. The serpentine path of refrigerant line 52 is configured such that heat transfer takes place across the walls of ice-forming cells 46A and to thermally conductive plate 70.

Those skilled in the art will appreciate that the regular rows and columns of ice-forming cells 46A illustrated in FIG. 4 can vary such that the number of rows and columns can be smaller or larger than that illustrated in FIG. 4. Further, although ice-forming cells 46A are shown in a regular row and column array, the relative position of the ice-forming cells to one another can vary over a wide range of geometric patterns. For example, ice-forming cells 46A can be arranged in concentric circles, rectangular or diamond patterns, and irregular arrays, and the like. Further, although in the exemplary embodiment, ice-forming cells 46A are positioned at right angles with respect to thermally conductive plate 70, in alternative embodiments of the invention, the ice-forming cells can be positioned at an angle other than 90° with respect to thermally conductive plate 70. For example, ice-forming cells 46A can be inclined at an acute or obtuse angle with respect to thermally conductive plate 70. Additionally, the ice-forming cells can have a non-round cross-sectional profile, such as a square, triangular, hexagonal, or octagonal profile, or the like. In this way, the ice machine can be customized to deliver a particular distinctive ice cube shape, which can convey a brand designation, or the like.

As illustrated in FIG. 4, thermally conductive plate 70 is generally rectangular shaped. In addition to shortened opposing side walls 86 and 88, thermally conductive plate 70 has opposing elongated sides 92 and 94. In the embodiment illustrated in FIG. 4, the regular array of ice-forming cells 46A includes three rows extending parallel to opposing elongated sides 92 and 94 and four columns extending parallel to opposing sides 86 and 88. In other embodiments of the invention, thermally conductive plate 70 can have a square geometry and house an array of ice-forming cells 46A that has an equal number of rows and columns. Alternatively, where ice-forming cells 46A are arranged in concentric circles, thermally conductive plate 70 can have a circular geometry.

To facilitate heat transfer between ice-forming cells 46A and 46B and refrigerant line 52, the thermally conductive plates 70 and 72, refrigerant line 52, and ice-forming cells 46A and 46B are constructed from a metal having high thermal conductivity. In a preferred embodiment, the metal parts of evaporator 48 are constructed from copper. Alternatively, other thermally conductive metals and metal alloys can be used. Correspondingly, the plastic parts of evaporator 48 and water manifold 44 are preferably constructed from a plastic material capable of being formed by injection molding. In one embodiment of the invention, the plastic parts of the ice machine are composed of an acrylonitrile-butadiene-styrene (ABS) plastic material. Materials other than ABS plastic, however, have a lower water absorption rate and may be preferred in some circumstances.

Figure 5:
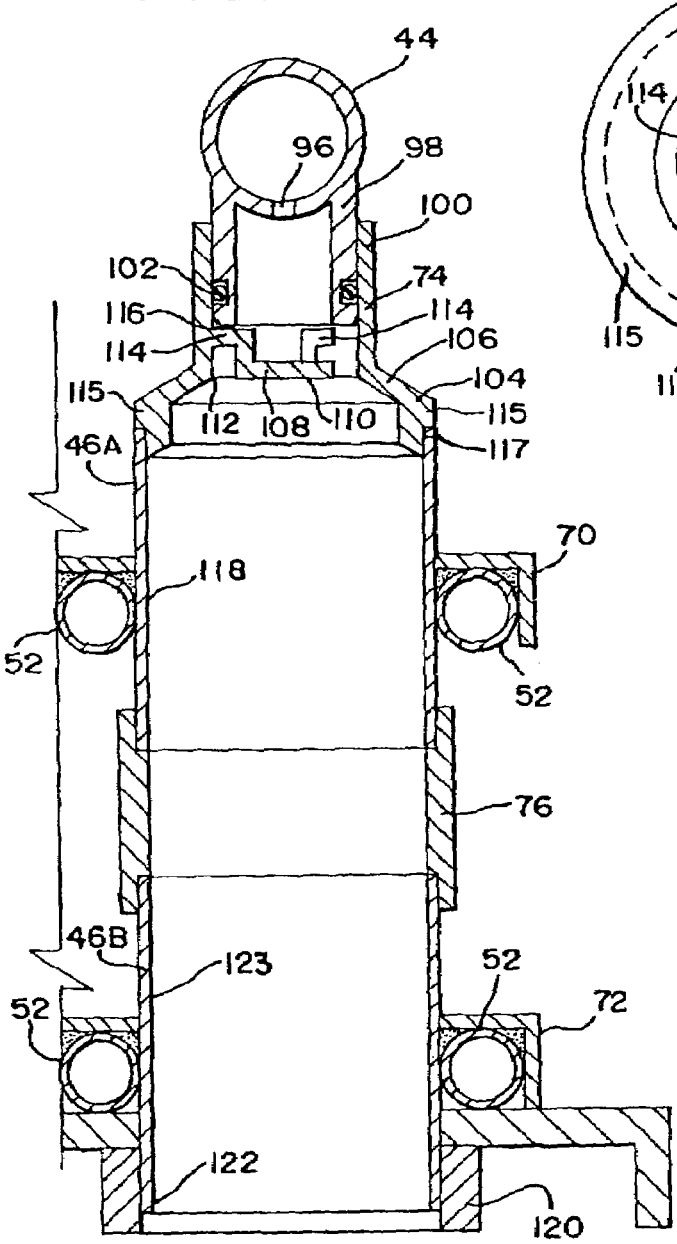
FIG. 5 is a cross-sectional view of the evaporator and distributor illustrated in FIG. 2 taken along section lines V—V of FIG. 2.

A cross-sectional view through one of ice-forming cells 46A and 46B of evaporator 48 taken along section line V—V of FIG. 2 is illustrated in FIG. 5. Water enters ice-forming cells 46A through an orifice 96 in a lower portion of manifold line 44. Preferably, the water in manifold line 44 is under pressure so that a stream of water flows rapidly out of orifice 96. An outlet shroud 98 of manifold line 44 is sealed against a first tube section 100 of water disperser 74 by an O-ring 102. First tube section 100 is integral with a second tube section 104 of water disperser 74. Second tube section 104 has a larger diameter than first tube section 100. First tube section 100 is connected with second tube section 104 by an incline section 106.

A splash plate 108 is positioned within water disperser 74 such that a bottom surface 110 of splash plate 108 is aligned with a transition point 112 between first tube section 100 and inclined section 106. Splash plate 108 is connected to the inner wall of first tube section 100 by L-shaped arms 114. L-shaped arms 114 attach to the inner surface of first tube section 100, such that splash plate 108 is positioned downstream from the location where L-shaped arms 114 attach to the inner surface of first tube section 100. Also, a terminal end 116 of outlet tube 98 abuts against L-shaped arms 114.

The particular configuration of L-shaped arms 114 functions to provide space between the inner wall of first tube section 100 and splash plate 108, and to avoid obstructing the flow of water from splash plate 108. The L-shaped configuration permits splash plate 108 to be attached to the inner wall of first tube section 100, while minimizing the obstruction to water flow at the upper surface of splash plate 108. By displacing splash plate 108 downstream from the point of attachment, water dispersed from splash plate 108 can travel directly to the inner surface first and second tube sections 100 and 104 and onto inner surface 118 of ice-forming cell 46A. Accordingly, L-shaped arms 114 assist in producing a uniform distribution of water on inner wall surface 118 of ice-forming cell 46A.

Refrigerant line 52 is positioned against upper thermally conductive plate 70 and ice-forming cell 46A; such that heat is sufficiently transferred from an inner wall surface 118 of ice-forming cell 46A. Coupler 76 is made of a thermally insulating material, such that refrigerant line 52 does not transfer heat from coupler 76. Accordingly, during operation of the ice machine, ice will not form on the inner surface of coupler 76 between ice-forming cell 46A and ice-forming cell 46B. The thermal insulator 120 is positioned around a lower end 122 of ice-forming cell 46B. Thermal insulator 120 prevents the formation of ice on the outer surface of lower end 122.

Figure 6:
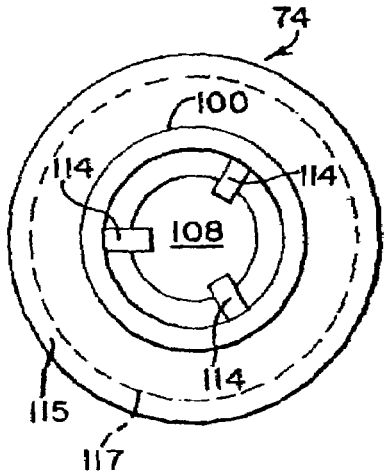
FIG. 6 is a top view of a water disperser illustrated in FIG. 5.

A top view of water disperser 74 is illustrated in FIG. 6. Splash plate 108 is a circular disk suspended in the center of first tube section 100. As water flows from orifice 96 in outlet shroud 98 it strikes the upper surface of splash plate 108 and is uniformly directed to the inner wall of first tube section 100. Referring back to FIG. 5, the water directed from splash plate 108 flows along the inner surface of incline section 106 and second tube section 104 and onto inner wall surface 118 of ice-forming cell 46A. The heat transfer taking place between ice-forming cell 46A and refrigerant line 52 causes ice to form on inner surface 118 of ice-forming cell 46A. Water that does not freeze on inner surface 118 flows down along inner surface 118 past coupler 76 and onto inner surface 123 of ice-forming cell 46B. Water also flows over ice previously formed on inner surface 118. Accordingly, the freezing action taking place in ice-forming cells 46A and 46B begins on the inner surface of the ice-forming cells and progresses toward the center axis of the ice-forming cells. In accordance with the a preferred embodiment of the invention, ice cubes are formed in the ice machine by an "outside-in" freezing process.

As shown in FIGS. 5 and 6, water disperser 74 has an overhang portion 115. Overhang portion 115 overlies the upper edge of ice-forming cell 46A. An insert portion 115 of water disperser 74 inserts into ice-forming cell 46A. Overhang portion 115 and insert portion 117 secures water disperser 74 in position at the upper end of ice-forming cell 46A.

In embodiment illustrated herein, evaporator 48 includes two overlying sets of ice-forming cells with a total of twenty four cells. Such a configuration is capable of producing about thirty five to about forty pounds of ice per day. Although the configuration of evaporator 48 illustrated herein includes two overlying thermally conductive plates, each containing a plurality of ice-forming cells, other configurations are possible. For example, more than two thermally conductive plates can be stacked on top of one another. In this manner, the capacity of the ice machine can be increased without increasing the machine's footprint. Also, a single thermally conductive plate can be used. Further, the diameter of the ice-forming cells can be larger or smaller than that illustrated herein.

Figure 7:
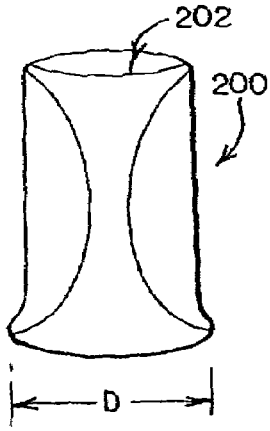
FIG. 7 is a perspective view of an ice cube produced by the ice making machine illustrated in FIG. 2.

An ice cube 200 produced by the ice making machine has the general appearance illustrated in FIG. 7. The "outside-in" freezing action taking place in ice-forming cells 46A and 46B produces ice cubes having a cylindrical outer surface and an hour-glass-shaped opening 202 in the center of the ice cube. During ice formation, liquid water continues to flow through the central portion of the ice-forming cells until such time as the central hole freezes closed or the freeze cycle is terminated and a harvest cycle is initiated. As will subsequently be described, a control unit continuously monitors the amount of water flowing through the evaporator and initiates a harvest cycle when the water flow through the evaporator becomes sufficiently restricted to indicate that the majority of the ice cubes have just about frozen closed.

The dimensions of the ice cubes produced by the ice machine of the preferred embodiment of the invention have generally the same dimensions as first and second ice-forming cells 46A and 46B. In one embodiment of the invention, the ice cubes produced are about 1.25 inches long and have a diameter "D" of about one inch to about 1.25 inches. Ice cubes produced by the preferred ice making machine of the invention vary in weight from about 12 to about 20 grams.

Figure 8:
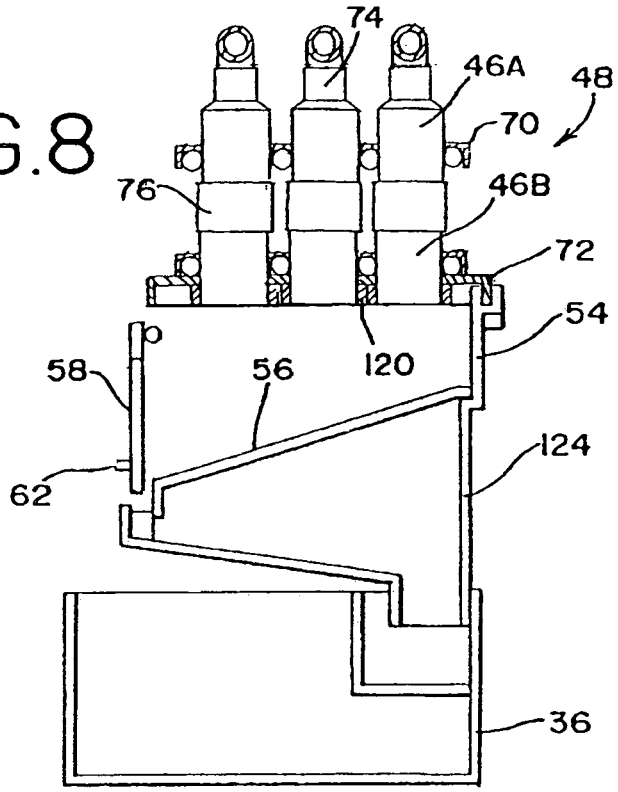
FIG. 8 is a partial cross-sectional view of the evaporator, ice detection unit, water collection unit, and sump of the ice making machine illustrated in FIG. 2 taken along section lines VIII—VIII.

A partial cross-sectional view of the assembly illustrated in FIG. 2 taken along section line VIII—VIII is shown in FIG. 8. As previously described, ice cubes falling from evaporator 48 into transfer compartment 54 are directed by slotted surface 56 toward damper 58. Ice damper switch 63 (shown in silhouette in FIG. 10) opens in response to movement of magnet 62 each time an individual ice cube or a number of ice cubes strike damper 58. Water that does not freeze into ice in evaporator 48 falls through the slots of slotted surface 56 and into a water collection unit 124. Water collection unit 124 is positioned over water sump 36 and delivers water flowing from evaporator 48 to water sump 36.

Figure 9:
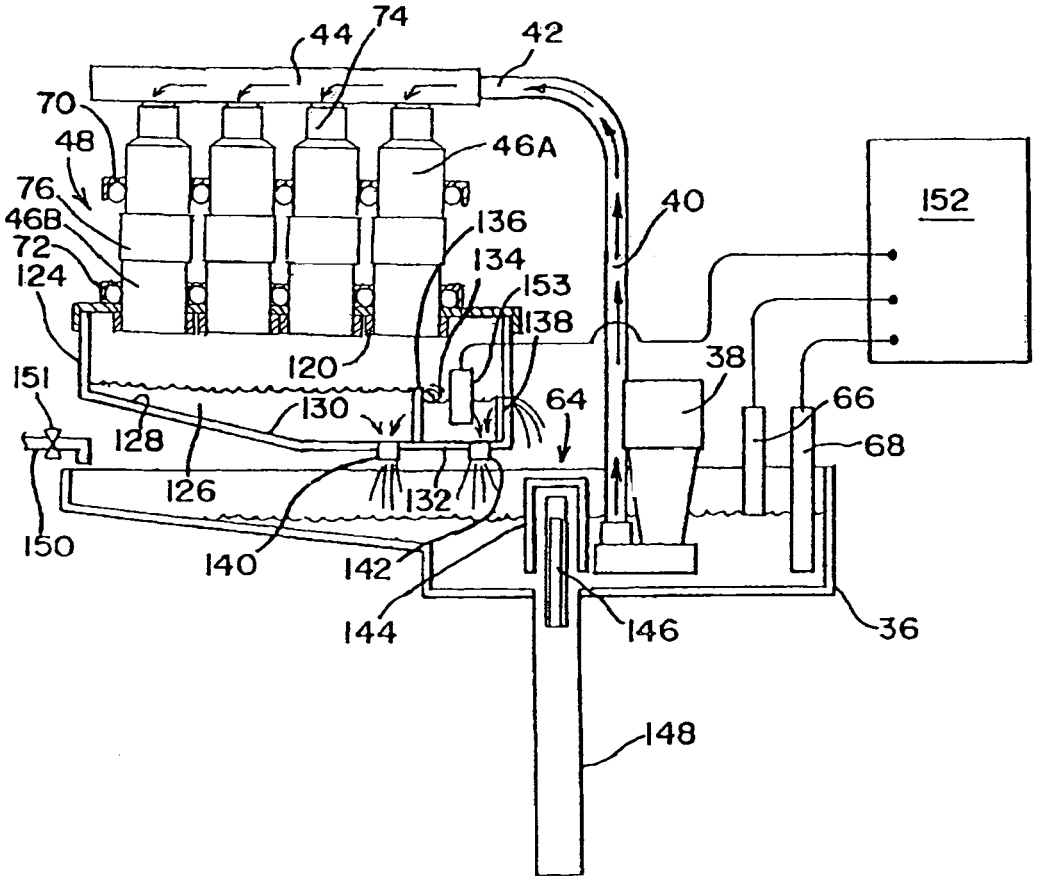
FIG. 9 is a schematic diagram of the water system of the ice making machine illustrated in FIG. 2.

FIG. 9 is a schematic diagram (not drawn to scale) of the water flow through the ice machine of FIGS. 2–8. Water flowing from the evaporator 48 falls into a first chamber 126 of water collection unit 124. A bottom surface 128 of water collection unit 124 includes an inclined portion 130 and a flat portion 132. A second chamber 134 is formed in water collection unit 124 by a weir 136 that rises from flat portion 132 of bottom surface 128. Second chamber 134 has an outer wall 138 opposite from weir 136.

Water can exit first chamber 126 either through a drain hole 140 located in flat portion 132 or over the top of weir 136 and into second chamber 134. Correspondingly, water flowing over the top surface of weir 136 can exit second chamber 134 by either flowing through a drain hole 142 located in flat portion 132 or over the top of outer wall 138.

Water can be expelled from water sump 36 by a sump drain system 64. A siphon cap 144 is positioned over a stand-pipe 146. Stand-pipe 146 is connected to a drain line 148. Fresh water is supplied to water sump 36 through water inlet line 150 and water valve 151.

Water recirculation through the ice machine is controlled by a control unit 152. Control unit 152 receives input signals from sensors positioned in water sump 36 and water collection unit 124. As previously described, sump sensor 66 and reference probe 68 reside in water sump 36. Sump sensor 66 is positioned to monitor the water level within water sump 36. A water detection probe 153 is positioned in second chamber 134 of water collection unit 124. Water detection probe 153 is preferably a capacitance probe.

Figure 10:
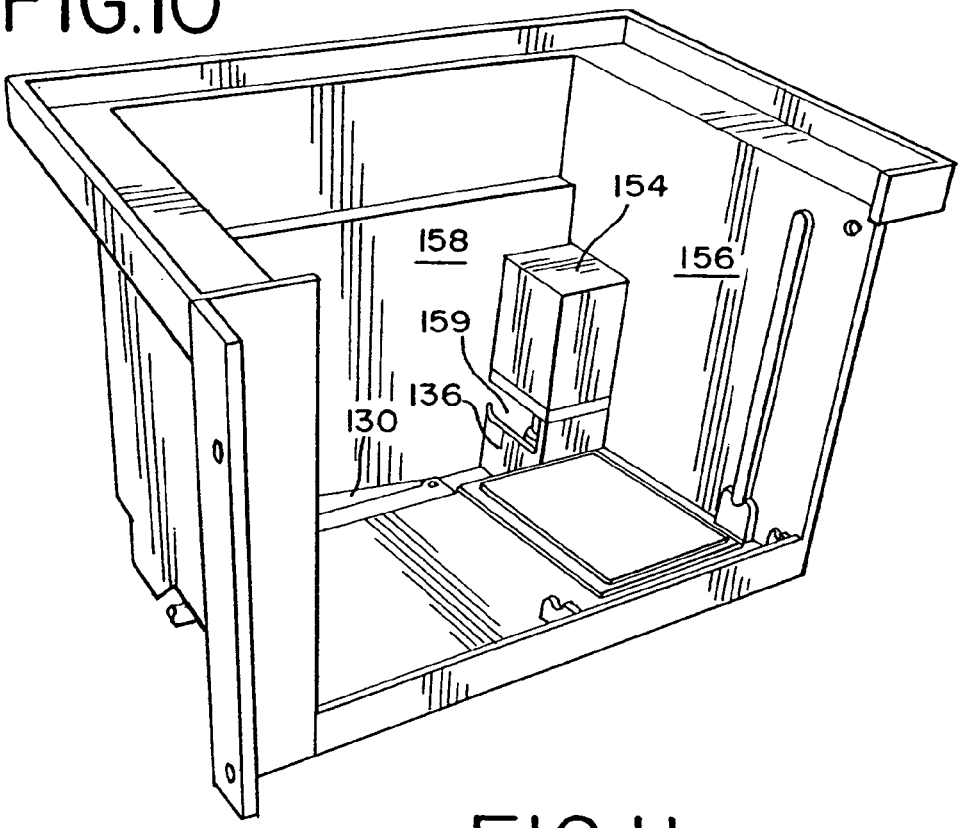
FIG. 10 is a perspective view of the water collection unit of the ice making machine illustrated in FIG. 2.

A perspective view of transfer compartment 54 and water collection unit 124 with slotted surface 56 and damper 58 removed is illustrated in FIG. 10. Water detection probe 153 resides in a probe housing 154. Probe housing 154 is positioned above second chamber 134 and is attached to a side wall 156 and a back wall 158. An opening 159 is created between the bottom of probe housing 154 and weir 136. Water can flow from first chamber 126 through opening 159 over weir 136 and into second chamber 134. As previously described, ice-damper switch 63, shown in silhouette, is positioned on transfer compartment 54 behind the right-side front panel.

Figure 11:
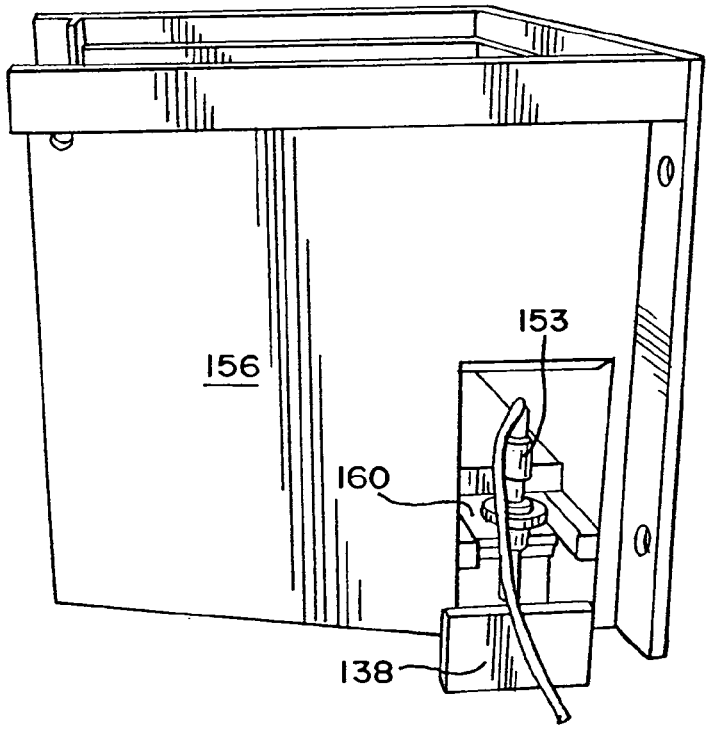
FIG. 11 is a side view of the water collection unit illustrated in FIG. 10.

A side view of water collection unit 124 is shown in FIG. 11. Water detection probe 153 is supported by a platform 160. The sensing end of water detection probe 153 extends into second chamber 134 a predetermined distance in order to sense the presence of water in second chamber 134.

Referring to FIGS. 9, 10, and 11, in accordance with the preferred embodiment of the invention, first and second chambers 126 and 134 are configured to transfer water from evaporator 48 to water sump 36 and to detect when ice cubes have formed in evaporator 48. During operation, water falls from evaporator 48 through slots in slotted surface 56, and is directed to drain hole 140 by inclined surface 130 in first chamber 126. Water also flows over the top of weir 136 into second chamber 134 and out of second chamber 134 through a restricted opening, such as drain hole 142, and over outer wall 138. When sufficient water flows from evaporator 48, the water level in first chamber 126 is high enough that water continuously flows over weir 136 and into second chamber 134. Under unrestricted flow conditions, water also flows from second chamber 134 over outer wall 138. Accordingly, the water retention capability of second chamber 134 is determined by the dimensions of second chamber 134, the height of weir 136, the height of outer wall 138, and the diameter of drain hole 142.

As ice cubes begin to form in evaporator 48, the flow of water from evaporator 48 becomes restricted by the ice that forms in ice-forming cells 46A and 46B. As the ice continues to form, progressively less and less water flows from evaporator 48. Depending upon the volume of first chamber 126, the diameter of drain hole 140 and the height of weir 136, at some point water stops flowing over the top of weir 136. At this point, the water remaining in second chamber 134 quickly drains out through drain hole 142, which uncovers water detection probe 153.

Control unit 152 continuously monitors probe 153 and, when the water level in second chamber 134 drops below probe 153, control unit 152 initiates a harvest cycle to harvest ice cubes from evaporator 48. In accordance with one embodiment of the invention, water detection probe 153 is uncovered when the volume of water flowing through evaporator 48 decreases by about ⅓ compared to the total unobstructed flow of water through the evaporator. The operational control of the preferred ice machine will be described below.

Figure 12:
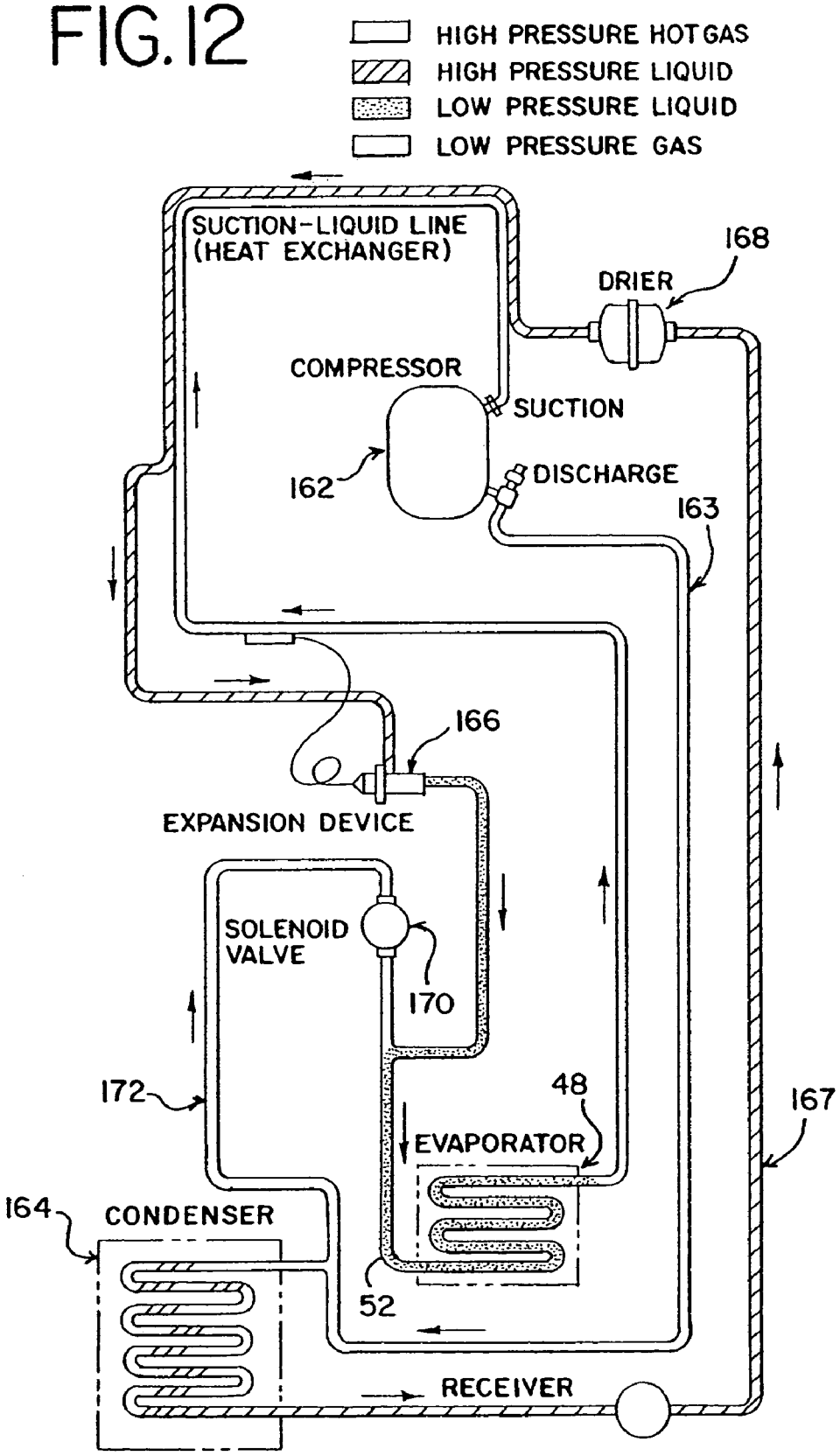
FIG. 12 is a schematic diagram of the refrigeration cycle of the ice making machine illustrated in FIG. 2.

The refrigeration system for the ice machine shown in FIG. 2 is illustrated in the schematic diagram of FIG. 12. The refrigeration system is primarily composed of a compressor 162, a condenser 164, an expansion device 166, an evaporator 48 (also shown in FIG. 2) and interconnecting lines 52, 163 and 167 therefor. In addition the refrigeration system also includes a refrigerant drier 168, a hot gas solenoid valve 170 to recycle hot gases through evaporator 48 after ice has been formed, thereby releasing the ice from evaporator 48, and interconnecting lines 172 therefor.

In operation, the refrigeration system contains an appropriate refrigerant, such as a hydrofluorocarbon known under the trade designation HFC-R-134a. The flow of refrigerant through the supply lines is shown by arrows and the physical state of the refrigerant at various locations is indicated by the highlighting scheme identified in FIG. 12. In the freeze cycle, compressor 162 receives a vaporous refrigerant at low pressure and compresses it, thus increasing the temperature and pressure of this refrigerant. Compressor 162 then supplies this high temperature, high pressure vaporous refrigerant though discharge line 163 to condenser 164, where the refrigerant condenses, changing from a vapor to a liquid. In this process, the refrigerant releases heat to the condenser environment, which is expelled from the ice machine.

The high pressure liquid refrigerant from condenser 164 flows through refrigerant supply line 167 to drier 168 and through expansion device 166, which is preferably a thermal expansion valve, and which serves to lower the pressure of the liquid refrigerant. An optional receiver is also shown in supply line 167. In a low volume ice making machine, a receiver may not be a necessary component of the refrigeration system. In a large ice machine, however, the heat transfer demand can be high enough to require the use of a receiver as illustrated in FIG. 12.

After passing through expansion device 166, the low pressure liquid refrigerant flows to evaporator 48 through refrigerant line 52 (also shown in FIG. 2), where the liquid refrigerant changes state to a vapor and, in the process of evaporating, absorbs latent heat from the surrounding environment. The vaporization of the refrigerant cools ice-forming cells 46A and 46B in evaporator 48. The refrigerant is converted from a liquid to a low pressure vaporous state and is returned to compressor 162 to begin the cycle again. During the freeze cycle, thermally conductive plates 70 and 72, and ice-forming cells 46A and 46B are cooled to well below 0° C., the freezing point of water.

The refrigeration system described herein can also contain a control circuit that causes the refrigeration system to cool down ice-forming cells 46A and 46B to well below freezing at the initial start up of the ice making machine to begin the freeze cycle. This improvement is described in U.S. Pat. No.

4,550,572, which is incorporated by reference herein. As a result of this improvement, on initial start up, evaporator 48 is cooled well below freezing prior starting water pump 38 and delivering water to the ice-forming cells. If desired, the below freezing cool down process can also be carried out during normal ice machine operation.

When the ice making machine goes into its harvest cycle, hot gas solenoid 170 opens and hot vaporous refrigerant is fed through line 172 into evaporator 48. The harvest cycle continues until control unit 152 determines that all of the ice cubes have fallen from ice-forming cells 46A and 46B.

The operational characteristics of the preferred ice machine of the invention will now be described. The operational features of the ice machine described below are summarized in Appendix A.

Start-up and Freeze Cycle Sequence

On initial unit startup, or on a restart of the unit, the damper switch is closed and water inlet valve 151 is opened. If sump sensor 66 is not in contact with water, water valve 151 opens until sump sensor 66 comes in contact with water. When the water level in water sump 36 rises to a level sufficient to contact sump sensor 66, water valve 151 is closed. After water valve 151 closes, hot gas solenoid 170 is activated for a about 20 seconds and hen the solenoid is closed and compressor 162 is activated. About 30 seconds after activating compressor 162, water pump 38 is started. The ice machine is now in a normal freeze cycle. During the first fifteen minutes of the freeze cycle, water detection probe 153 may or may not be in contact with water, therefore, signals from water detection probe 153 are ignored by control unit 152 for the first ten to fifteen minutes of every freeze cycle. During the freeze cycle, control unit 152 will continue to operate in the freeze cycle even if ice damper switch 63 is opened. Alternatively, the signal from probe 153 may be sampled to see if slush has formed and pump 38 is cavitating. If this occurs, a brief opening of water inlet solenoid 151 will bring in warmer, fresh water, causing the slush to melt.

If the master control switch is turned to the "Off" position during the freeze cycle, control unit 152 will stop the ice machine at once. If the master control switch is turned to the "Clean" position during a freeze cycle, control unit 152 will stop the ice machine at once, and initiate a clean cycle as described below.

Harvest Cycle

As ice cubes 200 form in evaporator 48, hole 202 in the center of the cubes will start to freeze closed and restrict the flow of water through ice-forming cells 46A and 46B of evaporator 48. When the water flow becomes sufficiently restricted, water will not overflow weir 136 into second chamber 134. At some point, the water level in second chamber 134 drops to a level that exposes water detection probe 153, whereupon control unit 152 triggers a harvest cycle. From the point in time that contact between the water and water flow probe 153 is broken, water pump 38 is shut off, and hot gas valve 170 is opened.

As ice cubes fall from evaporator 48 and into the storage bin, ice damper switch 63 will open and re-close several times. When a period of twenty seconds passes without detecting an opening of ice damper switch 63, control unit 152 presumes that all of the ice is harvested from evaporator 48. Hot gas solenoid 170 is closed about twenty seconds after the last time ice damper switch 63 opens. At this time, water pump 38 is started and water inlet valve 151 is opened. Water inlet valve 151 remains open until the water level in water sump 36 rises to a level sufficient to contact sump sensor probe 66. The ice machine is now in another freeze cycle.

If ice damper switch 63 remains open for about twenty continuous seconds, control unit 152 interprets this condition as indicating that the ice bin is full and ice is holding damper open. Control unit 152 then puts the ice machine into an auto shutdown mode. In auto shutdown, compressor 162 and water pump 38 are shut off and hot gas solenoid 166 and water inlet valve 151 are closed.

When ice damper switch 63 re-closes, if the ice machine has been off for three hundred seconds, control unit 152 restarts the start-up sequence described above. Alternatively, if the ice machine has not been off for three hundred seconds and damper switch 63 re-closes, control unit 152 delays restart until the three hundred second time period passes. This time period can be cancelled by turning the master control switch to the "Off" position, and back to the "On" position. After three hundred seconds in a harvest cycle, if ice damper switch 63 fails to open at least once, control unit 152 aborts the harvest cycle and returns the ice machine to a freeze cycle.

Flush Harvest Cycle

A flush harvest cycle is initiated on every fourth harvest cycle. As water flow becomes restricted due the formation of ice cubes in ice-forming cells 46A and 46B, water flow probe 153 in second chamber 134 will loose contact with the water. Control unit 152 shuts off water pump 38 and opens hot gas solenoid 170. As ice cubes fall from evaporator 48 and into the storage bin, ice damper switch 63 will open and re-close several times. Twenty seconds after the last time ice damper switch 63 opens, control unit 152 closes hot gas solenoid 170, and starts a condenser fan motor (not shown), water pump 38, and water inlet valve 151. Water pump 38 fills the water distributor, the evaporator, and the water collection unit with water from the sump. Water continues to flow into water sump 38 through inlet valve 151.

When water contacts sump sensor 66 the first time, water pump 38 is shut off. After shutting water pump 38 off, water from the distributor, evaporator, and water collection unit rapidly flows back into water sump 36. During this operation, water overflows stand-pipe 146 and starts the siphon effect, and water is continuously siphoned from water sump 36 by sump drain system 64.

Water is siphoned from water sump 36 much faster than water is introduced into water sump 36 though inlet valve 151. In one embodiment of the invention, water is siphoned through sump drain system 64 at about one to about two gallons per minute, and water flows through inlet 151 at a rate of about 0.25 gallons per minute. Accordingly, water drains out of water sump 36 and uncovers sump sensor 66. When the water level falls below the bottom of cap 144, air enters the stand-pipe 146 and the siphon stops. Water continues to flow into water sump 36 though inlet 151, thus once again raising the water level in water sump 36.

When water contacts sump sensor 66 the second time, water pump 38 is restarted. Water pump 38 again pumps into the water distributor, evaporator, and water collection unit, causing the water level in water sump 36 to drop and expose sump sensor 66. Water continues to flow into water sump 36 through inlet valve 151 steadily raising the water level in water sump 36. When water in the sump contacts sump sensor 66 a third time, water inlet valve 151 is closed. The ice machine is now in another freeze cycle.

If ice damper switch 63 remains open for twenty continuous seconds, control unit 152 determines that the ice bin is full and ice is holding damper 58 open. Control unit 152 then sets the ice machine in the auto shutdown mode described above.

If, after three hundred seconds in a harvest cycle, ice damper switch 63 fails to open at least once, control unit 152 will abort the harvest cycle and return the ice machine to a freeze cycle.

When ice damper switch 63 re-closes, if the ice machine has been off for three hundred seconds, control unit 152 initiates the start-up sequence outlined above. If the ice machine has not been off for three hundred seconds, and ice damper switch 63 re-closes, control unit 152 delays restart until the three hundred second time period passes. This time period can be cancelled by turning the master control switch to the "Off" position and back to the "On" position.

When the machine initially has power applied to it, or the master control switch is turned from the "Off" or "Clean" position to the "On" position, the count for the type of harvest cycle starts begins at "1". If the ice machine shuts down in an auto shutdown mode, control unit 152 stores the harvest cycle count sequence in memory and continues the count after restart.

Those skilled in the art will appreciate that a flush cycle can be carried out at various stages during operation of the ice machine. The need to perform a flush harvest cycle will vary depending upon the quality of water feed into the ice machine. For example, rather than every fourth cycle, where there is a high mineral concentration in the feed water, the flush cycle can be carried out more frequently. Alternatively, where water of high purity is supplied to the ice machine, a flush cycle can be carried out less frequently than every forth harvest cycle. The ice machine will be more efficient if the flush harvest cycle is less frequent because a fresh batch of warm water will not have to be cooled down as frequently. If the mineral content is too high, however, the ice quality will deteriorate.

Clean Cycle

When the master control switch is set in the "Clean" position, control unit 152 cycles through a programmed clean and rinse cycle. A summary of the operational sequence is provided in Appendix B.

When the master control switch is turned to the "Clean" position the clean sequence starts immediately. If the switch is turned back to the "Off" or to the "On" position during the first thirty seconds, the clean cycle is cancelled. After the first thirty seconds the clean cycle is locked in, the ice machine must complete the clean cycle. The ice machine will shut down if the master control switch is turned to the "Off" position, and continue later with the remaining part of the clean cycle when the master control switch is turned to "On" or to the "Clean" position. After the lock-in period has started, the master control switch can be turned to the "On" position, and the ice machine will return to the ice-making mode after the clean cycle is completed. The lock-in feature may be cancelled by turning the master control switch from the "Off" position to the "On" position three times in a ten second period or less.

Thus, it is apparent that there has been described, in accordance with the invention, a low volume ice making machine that fully provides the advantages set forth above. The preferred ice machine of the invention produces large, individual, clear ice cubes that can be handled by tongs and, accordingly, are desirable for residential use. The ice machine can be easily manufactured from inexpensive, injection molded plastic parts that can be formed to snap together. The metal parts of the evaporator can be easily made by an automated metal stamping and forming process. The evaporator design offers high reliability and requires infrequent maintenance. Further, the stacking feature of the evaporator design permits the ice capacity to be increased without increasing the foot-print of the ice machine.

Those skilled in the art will recognize that numerous modifications and variations can be made without departing from the spirit and scope of the invention. For example, the ice machine can include various types of electronic control devices, such as micro processor devices, micro controller devices, programmable logic devices, and the like. As described above, the flush harvest cycle, instead of being set to occur on every fourth or other fixed number of cycles, could be initiated after a variable number of cycles, which number can be set differently on each machine to take into account the conditions of the water supplied to a particular machine. Accordingly, all such variations and modifications are intended to be included within the scope of the appended claims and equivalents thereof.

| Ice Making Sequence of Operation | Toggle Switch Position | Ice Damper Switch | Hot Gas Solenoid | Water Inlet Solenoid | Water Pump | Compressor | Condenser Fan Motor | The system stays in this operating mode until: |
|---|---|---|---|---|---|---|---|---|
| Unit is Off | Off | Closed | Off | Off | Off | Off | Off | switch is manually turned |
| Unit Start-up Sequence | | | | | | | | |
| step 1. | On | Closed | Off | On | Off | Off | Off | sump sensor probe contacts water |
| step 2. | On | Closed | On | Off | Off | Off | Off | 20 seconds |
| step 3. | On | Closed | Off | Off | Off | On | On | 30 seconds |
| Freeze Cycle | On | Closed | Off | Off | On | On | On | water flow probe looses contact with water,(after the first fifteen minutes of the freeze cycle) |

-continued

| Ice Making Sequence of Operation | Toggle Switch Position | Ice Damper Switch | Hot Gas Solenoid | Water Inlet Solenoid | Water Pump | Compressor | Condenser Fan Motor | The system stays in this operating mode until: |
|---|---|---|---|---|---|---|---|---|
| Non-dump Harvest Cycle | | | | | | | | |
| step 1. | On | Open/Close | On | Off | Off | On | Off | 20 seconds after last damper switch opens/ recloses |
| step 2. | On | Closed | Off | On | On | On | On | water contacts the sump sensor probe. |
| Freeze Cycle The first three cycles are followed by a non-flush harvest Cycle. The fourth freeze cycle is followed by a flush harvest cycle. Then the pattern repeats. | On | Closed | Off | Off | On | On | On | water flow probe looses contact with water, (after the first fifteen minutes of the freeze cycle) |
| Flush Harvest Cycle | | | | | | | | |
| step 1. | On | Opend/Close | On | Off | Off | On | Off | 20 seconds after last damper switch opens/re-closes |
| step 2. | On | Closed | Off | On | On | On | On | until water contacts sump sensor probe first time |
| step 3. | On | Closed | Off | On | Off | On | On | until water contacts sump sensor probe the second time |
| step 4. | On | Closed | Off | On | On | On | On | until water contacts sump sensor the third time |
| Freeze Cycle | On | Closed | Off | Off | On | On | On | water flow probe looses contact with water, (after the first fifteen minutes of the freeze cycle) |
| Auto Shut-off | On | Open 20 seconds | Off | Off | Off | Off | Off | Ice damper switch recloses, and a minimum of 300 seconds of off time. |

| Sequence of Operation for a Clean Cycle | Toggle Switch Position | Ice Damper Switch | Hot Gas Solenoid | Water Inlet Solenoid | Water Pump | Compressor | Condenser Fan Motor | The system stays in this operating mode until: |
|---|---|---|---|---|---|---|---|---|
| Clean Cycle is Initiated | | | | | | | | |
| step 1 | Clean | Closed | Off | On | Off | Off | Off | sump sensor probe contacts water |
| step 2 | Clean | Closed | Off | Off | On | Off | Off | 600 seconds |
| step 3 | Clean | Closed | Off | On | On | Off | Off | 15 seconds |
| step 4 | Clean | Closed | Off | Off | Off | Off | Off | 15 seconds |
| step 5 | Clean | Closed | Off | On | Off | Off | Off | sump sensor probe contacts water |
| step 6 | Clean | Closed | Off | Off | On | Off | Off | 60 seconds |
| step 7 | Clean | Closed | Off | On | On | Off | Off | 15 seconds |
| step 8 | Clean | Closed | Off | Off | Off | Off | Off | 15 seconds |
| step 9 | Clean | Closed | Off | On | Off | Off | Off | sump sensor probe contacts water |
| step 10 | Clean | Closed | Off | Off | On | Off | Off | 60 seconds |
| step 11 | Clean | Closed | Off | On | On | Off | Off | 15 seconds |
| step 12 | Clean | Closed | Off | Off | Off | Off | Off | 15 seconds |
| step 13 | Clean | Closed | Off | On | Off | Off | Off | sump sensor probe contacts water |
| step 14 | Clean | Closed | Off | Off | On | Off | Off | 60 seconds |
| step 15 | Clean | Closed | Off | On | On | Off | Off | 15 seconds |
| step 16 | Clean | Closed | Off | Off | Off | Off | Off | 15 seconds |
| step 17 | Clean | Closed | Off | On | Off | Off | Off | sump sensor probe contacts water |
| step 18 | Clean | Closed | Off | Off | On | Off | Off | 60 seconds |
| step 19 | Clean | Closed | Off | On | On | Off | Off | 15 seconds |
| step 20 | Clean | Closed | Off | Off | Off | Off | Off | 15 seconds |
| Clean cycle is complete | | | | | | | | |

The invention claimed is:

1. An ice machine comprising:

(a) an evaporator having a plurality of individual ice-forming cells, each cell having a closed perimeter and an opening at a lower end;

(b) a water distributor coupled to the evaporator and configured to deliver water at or near an upper end of each of the plurality of individual ice-forming cells;

(c) a water disperser in an upper end of each of the plurality of individual ice-forming cells, wherein the water disperser is configured to disperse the flow of water from the water distributor into the upper end of the ice-forming cells so that the water flows downward inside the perimeter of the individual ice-forming cells;

(d) a water recirculation system including a sump, a water pump positioned within the sump, and a water recirculation line coupled to the water pump and to the water distributor; and (e) a refrigeration system configured to cool each of the plurality of ice-forming cells from outside the perimeter, such that individual ice cubes are formed in the ice-forming cells.

2. The ice machine of claim 1 wherein the refrigeration system is further configured to heat each of the ice-forming cells during a harvest cycle, such that the ice cubes are released and delivered from the lower end of each ice-forming cell.

3. The ice machine of claim 1 wherein the evaporator comprises:

(a) a thermally conductive plate extending in a first plane, wherein each of the plurality of ice-forming cells are positioned within the thermally conductive plate, and wherein each cell has longitudinal axis extending in a direction substantially perpendicular to the plane; and (b) a heat transfer conduit secured to the thermally conductive plate in proximity to each of the plurality of individual ice-forming cells.

4. The ice machine of claim 3 wherein the thermally conductive plate, the ice-forming cells, and heat transfer conduit comprise copper metal.

5. The ice machine of claim 3 wherein the ice-forming cells and the heat transfer conduit are solder bonded to the thermally conductive plate.

6. The ice machine of claim 3 wherein the heat transfer conduit is thermally coupled to each of the individual ice-forming cells such that water coming in contact with an inner wall of each individual ice-forming cell will freeze into ice on the inner wall.

7. The ice machine of claim 3 wherein the individual ice-forming cells are positioned in an array of holes in the thermally conductive plate.

8. The ice machine of claim 3 wherein the thermally conductive plate comprises an upper surface and a lower surface, and wherein side walls depend from the lower surface along a perimeter of the thermally conductive plate.

9. The ice machine of claim 3 wherein the plurality of ice-forming cells are positioned within the thermally conductive plate such that the first plane crosses a midsection of each ice-forming cell.

10. The ice machine of claim 3 wherein the thermally conductive plate comprises a rectangular plate having a long side and a short side, and wherein the array of holes comprises rows extending parallel to the long side and columns extending parallel to the short side.

11. The ice machine of claim 10 wherein the heat transfer conduit comprises a serpentine tube secured to the lower surface and to the side walls of the thermally conductive plate and traverses between adjacent rows of the ice-forming cells.

12. The ice machine of claim 11 wherein the serpentine tube is configured such that a heat transfer fluid entering the serpentine tube is first directed between adjacent inner rows of the ice-forming cells.

13. The ice machine of claim 3 wherein a bottom portion of each individual ice-forming cell extends below the lower surface of the thermally conductive plate, and wherein the evaporator further comprises a thermal insulator surrounding the bottom portion of the individual ice-forming cells.

14. The ice machine of claim 1 wherein the water disperser is configured to direct a flow of water under pressure from the water distributor onto an inner wall at the upper end of the ice-forming cell.

15. The ice machine of claim 14 wherein the water disperser further comprises a splash plate positioned within the water disperser by L-shaped arms attached to an inner surface of the water disperser.

16. The ice machine of claim 1 wherein the water disperser comprises a first tube section having a first diameter and a second tube section downstream of the first tube section and having a second diameter, wherein the second diameter is greater than the first diameter, and wherein the second tube section is coupled to the upper end of the ice-forming cell.

17. The ice machine of claim 16 wherein the water disperser further comprises a splash plate positioned within the first tube and attached to an inner wall of the first tube by L-shaped arms, such that the splash plate is positioned down stream from a point of attachment of the L-shaped arms to the inner wall of the first tube.

18. The ice machine of claim 17 wherein the splash plate comprises an upper surface and a lower surface, and wherein the lower surface of the splash plate is aligned with a transition point between the first tube and the second tube, such that the flow of water contacting the splash plate passes between the splash plate and the L-shaped arms and is uniformly dispersed on an inner wall of the second tube.

19. The ice machine of claim 1 wherein the plurality of individual ice-forming cells are arranged in rows, and wherein the water distributor further comprises a manifold coupled to the water recirculation line and having a plurality of water supply lines, wherein each supply line is coupled to each water dispenser in a row of individual ice-forming cells.

20. The ice machine of claim 1 wherein the evaporator comprises:

(a) a first thermally conductive plate;

(b) a second thermally conductive plate below the first thermally conductive plate; and (c) a heat transfer conduit secured to the first and second thermally conductive plates in proximity to each of the plurality of individual ice-forming cells, wherein each of the plurality of ice-forming cells comprises a first cell positioned within the first plate thermally conductive plate and a second cell positioned within the second thermally conductive plate, and wherein the first and second cells are connected together by a thermally insulating coupler.

21. The ice machine of claim 20 wherein the thermally insulating coupler comprises injection molded plastic having low water absorption and a lateral dimension substantially the same as the lateral dimension of the first and second cells.

22. The ice machine of claim 1 further comprising:

(a) a water collection unit positioned below the evaporator and above the sump, the water collection unit having a first chamber separated from a second chamber by a weir, wherein each chamber includes a drain hole in a bottom surface thereof; and (b) a water detection probe positioned within the second chamber, wherein the first chamber is configured to collect water flowing through the plurality of individual ice-forming cells and to direct the water though the drain hole in the bottom surface of the first chamber and over the weir into the second chamber.

23. The ice machine of claim 22 wherein the second chamber includes an outer wall opposite the weir, the outer wall having a vertical height less than a vertical height of the weir, such that water can flow from the second chamber over the outer wall and into the sump.

24. The ice machine of claim 23 wherein the second chamber is configured such that a reduction of water flow from the plurality of individual ice-forming cells will reduce a water level in the second chamber to a position below a sensing end of the water detection probe.

25. The ice machine of claim 22 wherein the bottom surface of the first chamber is inclined such that water will flow toward the weir, and wherein the drain hole in the first chamber is located in proximity to the weir.

26. An ice machine comprising:

(a) a multi-level evaporator having at least two levels, wherein each level includes a plurality of individual ice-forming cells, each ice-forming cell having a closed perimeter and an opening at a lower end, wherein the ice-forming cells are vertically aligned to form vertical cell stacks, and wherein a thermal insulator is positioned between the ice-forming cells in the vertical cell stacks;

(b) a water distributor coupled to the evaporator and configured to deliver water at or near an upper end of each of the plurality of individual ice-forming cells in an uppermost level; and (c) a water recirculation system including a sump, a water pump positioned within the sump, and a water recirculation line coupled to the water pump and to the water distributor, wherein the water distributor is configured to deliver water to the multi-level evaporator such that the water flows downward from the uppermost level in each cell stack and out of the multi-level evaporator through a lowermost level and into the sump.

27. The ice machine of claim 26 further comprising a refrigeration system configured to cool each of the plurality of ice-forming cells from outside the perimeter, such that individual ice cubes are formed in the ice-forming cells.

28. The ice machine of claim 26 wherein each level of the multi-level evaporator comprises:

(a) a thermally conductive plate; and (b) a heat transfer conduit secured to the thermally conductive plate in proximity to each of the plurality of individual ice-forming cells, wherein each of the plurality of ice-forming cells comprises an elongated metal structure having a longitudinal axis substantially perpendicular to the thermally conductive plate.

29. The ice machine of claim 28 wherein the elongated metal structure has a cross sectional geometry selected from the group consisting of square, circular, triangular, pentagonal, hexagonal, and octagonal.

30. The ice machine of claim 28 wherein each of the ice-forming cells are attached to the thermally conductive plate at a midsection of the ice-forming cell.

31. An ice machine comprising:

(a) evaporator means having a plurality of individual ice-forming cells, each cell having a closed perimeter and an opening at a lower end;

(b) water distributor means coupled to the evaporator means for delivering water at or near an upper end of each of the plurality of individual ice-forming cells;

(c) water recirculation means for recirculating water that passes through the ice-forming cells back to the water distributor means;

(d) water flow sensing means for determining the amount of water passing through the ice forming cells; and (e) refrigeration means for cooling each of the plurality of ice-forming cells from outside the perimeter, such that individual ice cubes are formed in the ice-forming cells.

32. The ice machine of claim 31 wherein the evaporator means comprises a multi-level evaporator having at least two levels, wherein each level includes a plurality of individual ice-forming cells, wherein the ice-forming cells are vertically aligned to form vertical cell stacks, and wherein a thermal insulator is positioned between the ice-forming cells in the vertical cell stacks.

33. The ice machine of claim 31 wherein the water flow sensing means comprises:

(a) a water collection unit positioned below the evaporator means and upstream of the water recirculation means, the water collection unit having a first chamber separated from a second chamber by a weir, wherein each chamber includes a drain hole in a bottom surface thereof; and (b) a water detection probe positioned within the second chamber, wherein the first chamber is configured to collect water flowing through the plurality of individual ice-forming cells and to direct the water though the drain hole in the bottom surface of the first chamber and over the weir into the second chamber.

34. The ice machine of claim 31 further comprising a water disperser in an upper end of each of the plurality of individual ice-forming cells, wherein the water disperser includes a splash plate positioned within the water disperser and attached to an inner wall thereof, wherein the splash plate directs a flow of water entering the upper end of the ice-forming cell outward onto an inner surface of the ice-forming cell.

* * * * *

UNITED STATES PATENT AND TRADEMARK OFFICE

CERTIFICATE OF CORRECTION

PATENT NO. : 7,082,782 B2
APPLICATION NO. : 10/898449
DATED : August 1, 2006
INVENTOR(S) : Charles E. Schlosser et al.

It is certified that error appears in the above-identified patent and that said Letters Patent is hereby corrected as shown below:

Column 18, in claim 20, line 10, after "positioned within the first" delete "plate".

Column 19, in claim 22, line 11, before "the drain hole in the" delete "though" and substitute --through-- in its place.

Column 20, in claim 33, line 13, before "the drain hole in the" delete "though" and substitute --through-- in its place.

Signed and Sealed this

Third Day of April, 2007

JON W. DUDAS
*Director of the United States Patent and Trademark Office*